US009808814B2

(12) United States Patent
Yamada

(10) Patent No.: US 9,808,814 B2
(45) Date of Patent: Nov. 7, 2017

(54) ELECTROSTATIC COATING APPARATUS

(71) Applicant: ABB K.K., Shinagawa-ku (JP)

(72) Inventor: Yukio Yamada, Fujieda (JP)

(73) Assignee: ABB K.K., Shinagawa-ku (JP)

( * ) Notice: Subject to any disclaimer, the term of this patent is extended or adjusted under 35 U.S.C. 154(b) by 0 days.

(21) Appl. No.: 14/402,770

(22) PCT Filed: May 15, 2013

(86) PCT No.: PCT/JP2013/063561
§ 371 (c)(1),
(2) Date: Nov. 21, 2014

(87) PCT Pub. No.: WO2013/183416
PCT Pub. Date: Dec. 12, 2013

(65) Prior Publication Data

US 2015/0136022 A1 May 21, 2015

(30) Foreign Application Priority Data

Jun. 6, 2012 (JP) ..... 2012-128888

(51) Int. Cl.
*B05B 5/025* (2006.01)
*B05B 3/02* (2006.01)
(Continued)

(52) U.S. Cl.
CPC ..... *B05B 5/057* (2013.01); *B05B 5/025* (2013.01); *B05B 5/0403* (2013.01);
(Continued)

(58) Field of Classification Search
USPC ..... 118/620–640, 321, 323; 239/223, 224, 239/699–708; 427/475, 477, 485, 486
See application file for complete search history.

(56) References Cited

U.S. PATENT DOCUMENTS 5,788,165 A 8/1998 Sakakibara et al.
6,230,994 B1 5/2001 Boerner et al.
(Continued)

FOREIGN PATENT DOCUMENTS

JP 2 95556 7/1990
JP 9 220497 8/1997
(Continued)

OTHER PUBLICATIONS

International Search Report Issued Aug. 20, 2013 in PCT/JP13/063561 Filed May 15, 2013.
U.S. Appl. No. 14/402,870, filed Nov. 21, 2014, Yamada, et al.

*Primary Examiner* — Yewebdar Tadesse
(74) *Attorney, Agent, or Firm* — Oblon, McClelland, Maier & Neustadt, L.L.P.

(57) ABSTRACT

A rotary atomizing head (4) is mounted on a front end side of an air motor (3). A shaping air ring (9) with air spout holes (10, 11) formed therein is provided on the rear side of the rotary atomizing head (4). The shaping air ring (9) is formed of a conductive material and is connected to ground. External electrode units (13) are provided in the periphery of the rotary atomizing head (4). A film cover (17) made of an insulating material is provided to cover an outer peripheral side of the air motor (3). A semi conductive member (21) is replaceably mounted to an adaptor (16) provided on an outer peripheral side of the shaping air ring (9). A rear end part (21B) of the semi conductive member (21) is made in contact with a front end part (19D) of the film cover (17). A front end part (21C) of the semi conductive member (21) is made in contact with the shaping air ring (9).

7 Claims, 9 Drawing Sheets

(51) Int. Cl.

| | |
|---|---|
| ***B05B 5/057*** | (2006.01) |
| ***B05B 5/04*** | (2006.01) |
| ***B05B 15/04*** | (2006.01) |
| ***H01B 13/00*** | (2006.01) |

(52) U.S. Cl.
CPC ..... *B05B 5/0407* (2013.01); *B05B 5/0426* (2013.01); *B05B 15/045* (2013.01); *H01B 13/0026* (2013.01)

(56) References Cited

U.S. PATENT DOCUMENTS

| | | | | |
|---|---|---|---|---|
| 7,546,962 | B2 * | 6/2009 | Yamada | B05B 5/04 118/629 |
| 8,978,580 | B2 * | 3/2015 | Yamada | B05B 5/0426 118/621 |
| 2010/0206225 | A1 * | 8/2010 | Yamada | B05B 5/0535 118/629 |
| 2011/0271906 | A1 | 11/2011 | Yamada | |

FOREIGN PATENT DOCUMENTS

| | | |
|---|---|---|
| JP | 11 276937 | 10/1999 |
| JP | 2000 117155 | 4/2000 |
| WO | 2007 015335 | 2/2007 |
| WO | 2010 131541 | 11/2010 |

* cited by examiner

ELECTROSTATIC COATING APPARATUS

TECHNICAL FIELD

The present invention relates to an electrostatic coating apparatus for atomizing paint in a state of applying a high voltage thereto.

BACKGROUND ART

In general, there is known an electrostatic coating apparatus that is provided with, for example, a rotary atomizing head that is rotatably provided on the front side of an air motor by the air motor, external electrode units provided in the periphery of the rotary atomizing head, and a high voltage generator that applies a high voltage to the external electrode unit to indirectly charge paint particles atomized from the rotary atomizing head with the high voltage (Patent Documents 1, 2).

Patent Document 1 discloses the configuration in which an air motor is mounted to a housing member, and the housing member and the external electrode unit are covered with a cover made of an insulating material. Patent Document 2 discloses the configuration in which a shaping air ring with air spout holes is provided on the rear side of the rotary atomizing head and is be connected to ground.

PRIOR ART DOCUMENTS

Patent Documents

Patent Document 1: WO 2007/015335 A1
Patent Document 2: WO 2010/131541 A1

SUMMARY OF THE INVENTION

Incidentally, in the electrostatic coating apparatus according to Patent Document 1, when a minus high voltage is applied to the external electrode unit, corona ions by corona discharge are generated in the vicinity of a front end of the external electrode unit. Therefore, an outer surface of the cover is charged with negative polarity of the discharged minus ions.

At this time, a front end part of the cover is arranged in a state of being in contact with or close to the shaping air ring. When the shaping air ring is connected to ground in this state as in the case of the electrostatic coating apparatus according to Patent Document 2, since discharge and charge of electric charge are repeated between the front end part and the shaping air, the front end part of the cover has a tendency to be easily degraded.

On the other hand, in consideration of weight-reduction and facilitation of maintenance for the coating apparatus, it is preferable to use an insulating resin film that is inexpensive, excellent in formability and has a thickness of 1 mm or less for the cover. However, in a case where such an insulating resin film is used as the cover, there is a problem that electrostatic coating for about several hours causes cracks or defects to be generated in the front end part of the cover due to the degradation.

In view of the above-discussed problems with the conventional art, it is an object of the present invention to provide an electrostatic coating apparatus that can suppress degradation of a cover to enhance durability thereof.

(1) According to the present invention, an electrostatic coating apparatus comprises a motor; a rotary atomizing head that is provided on a front side of the motor to be rotatable by the motor; an external electrode unit that is provided in the periphery of the rotary atomizing head; and a high voltage applying unit that applies a high voltage to the external electrode unit to indirectly charge paint particles atomized from the rotary atomizing head with the high voltage, characterized in that: an earth member that is provided on the rear side of the rotary atomizing head to be connected to ground; a film cover that is formed by an insulating material and covers an outer peripheral side of the motor; and a semi conductive member that is formed by a semi conductive material, and one end part of which is in contact with the film cover and the other end part of which is in contact with the earth member.

With this arrangement, the corona ions by the corona discharge are generated in the vicinity of the external electrode unit to form a minus ionization zone by the corona ions. Therefore, the paint particles atomized from the rotary atomizing head pass through the ionization zone to be charged with the minus high voltage and to be charged paint particles.

On the other hand, the outer surface of the film cover is charged with negative polarity of the discharged minus ions. Here, the earth member is provided on the rear side of the rotary atomizing head, and one end part of the semi conductive member is in contact with the film cover and the other end part of the semi conductive member is in contact with the earth member. Therefore, the electric charge charged the film cover is discharged to the semi conductive member, but as compared to a case of being directly discharged to the earth member, intensive large electrical current cannot be formed for a short time to be slow electrical current. As a result, the degradation of the film cover can be suppressed to enhance durability thereof.

Further, the ions from the external electrode unit tend to easily concentrate on the semi conductive member in contact with the earth member. However, since the semi conductive member is a resistive element having higher volume resistivity and higher surface resistivity as compared to a metallic material, an electrical potential gradient is formed in the semi conductive member an electrical potential of which becomes high. At this time, since the semi conductive member is charged with same polarity as that of the charged paint particles, the charged paint particle is more difficult to adhere thereto as compared to the earth member, making it possible to suppress the contamination.

(2) According to the present invention, a shaping air ring in which an air spout hole for spouting shaping air is formed is provided on the rear side of the rotary atomizing head, and the shaping air ring configures the grounded earth member that is formed using a conductive material.

With this arrangement, since the shaping air ring configures the earth member, it is not necessary to provide another member only for grounding the other end part of the semi conductive member. In addition, since the discharge is generated in the periphery of the grounded shaping air ring, ions can be supplied to the periphery of the air spout hole to accelerate the charging of the paint particles through the shaping air.

(3) According to the present invention, the shaping air ring is provided with an adaptor made of an insulating material or semi conductive material, and the semi conductive member is replaceably mounted to the adaptor.

With this arrangement, since the shaping air ring is provided with the adaptor made of the insulating material or semi conductive material, insulation properties between the film cover and the shaping air ring can be enhanced to suppress direct discharge therebetween. Since the other end part of the semi conductive member is in contact with the shaping air ring, the electrical potential thereof becomes closer to the earth as compared to the film cover, and paint particles tend to easily adhere thereto. At this time, since the semi conductive member is replaceably mounted to the adaptor, only the semi conductive member that is easily contaminated can be easily replaced, and maintenance properties thereof can be enhanced as compared to a case where the semi conductive member and the film cover both are together replaced.

(4) According to this present invention, the shaping air ring is provided with an inside engaging part in a position opposed to the midway part between one end part and the other end part of the semi conductive member, and the semi conductive member is provided with an outside engaging part engaging with the inside engaging part of the shaping air ring, wherein the semi conductive member is replaceably mounted to the shaping air ring in a state where the outside engaging part is engaged with the inside engaging part.

With this arrangement, since the shaping air ring is provided with the inside engaging part and the semi conductive member is provided with the outside engaging part, the semi conductive member can be replaceably mounted to the shaping air ring in a state where the outside engaging part is engaged with the inside engaging part. Therefore, only the semi conductive member that is easily contaminated can be easily replaced, and maintenance properties thereof can be enhanced as compared to a case where the semi conductive member and the film cover both are together replaced.

(5) According to the present invention, the external electrode unit includes an electrode support arm, and a needle electrode member that is provided in the electrode support arm and to which a high voltage is applied from the high voltage applying unit, the film cover covers the electrode support arm of the external electrode unit in addition to the motor, and the needle electrode member of the external electrode unit is exposed from an electrode opening formed in the film cover.

With this arrangement, since the needle electrode member of the external electrode unit is exposed from the electrode opening formed in the film cover, ions from the needle electrode member can be supplied to the paint particles. Since the film cover covers the electrode support arm of the external electrode unit in addition to the motor, the electrode support arm can be prevented from being contaminated to be kept clean.

(6) According to the present invention, the motor is supported to a housing member, and the film cover includes a cylindrical rear cover mounted to the housing member and a cylindrical front cover mounted on the front side of the rear cover to cover the motor.

With this arrangement, even when the paint particle adheres to the film cover, the film cover can be removed from the housing member by separating the front cover from the rear cover. Therefore, the film cover can be easily replaced to enhance maintenance properties thereof.

(7) According to the present invention, the motor is supported to a housing member, the housing member is provided with an electrode cover part covering the external electrode unit, and the film cover is configured of a cylindrical front cover mounted on the front side of the electrode cover part to cover the motor.

With this arrangement, even when the paint particle adheres to the front cover, the front cover can be removed from the housing member by separating the front cover from the electrode cover part. Therefore, the front cover can be easily replaced to enhance maintenance properties thereof.

MODE FOR CARRYING OUT THE INVENTION

Hereinafter, an electrostatic coating apparatus according to an embodiment of the present invention will be in detail explained with reference to the accompanying drawings by taking a rotary atomizing head type coating apparatus as an example.

FIG. 1 to FIG. 6 show a first embodiment of an electrostatic coating apparatus in the present invention.

Figure 1:
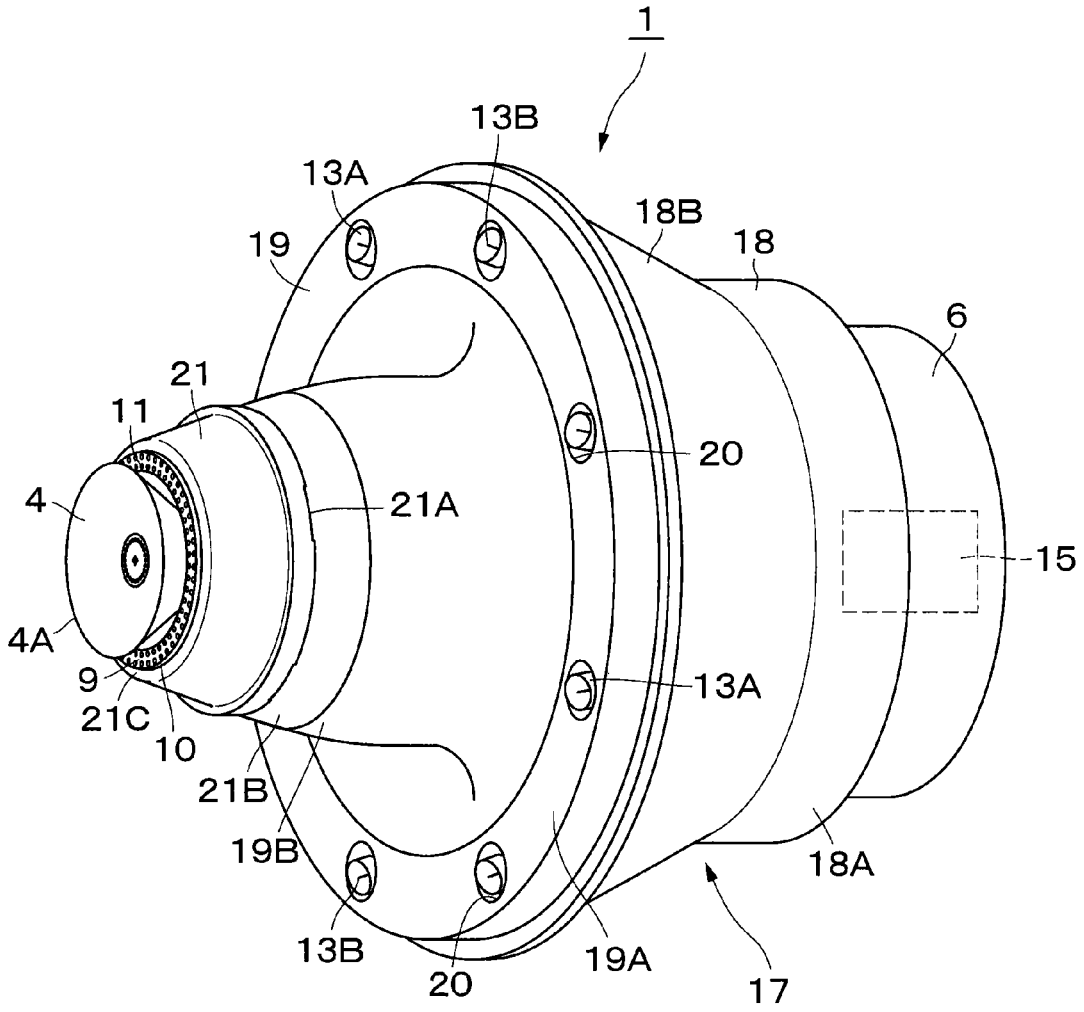
FIG. 1 is a perspective view showing a rotary atomizing head type coating apparatus according to a first embodiment in the present invention.
Figure 2:
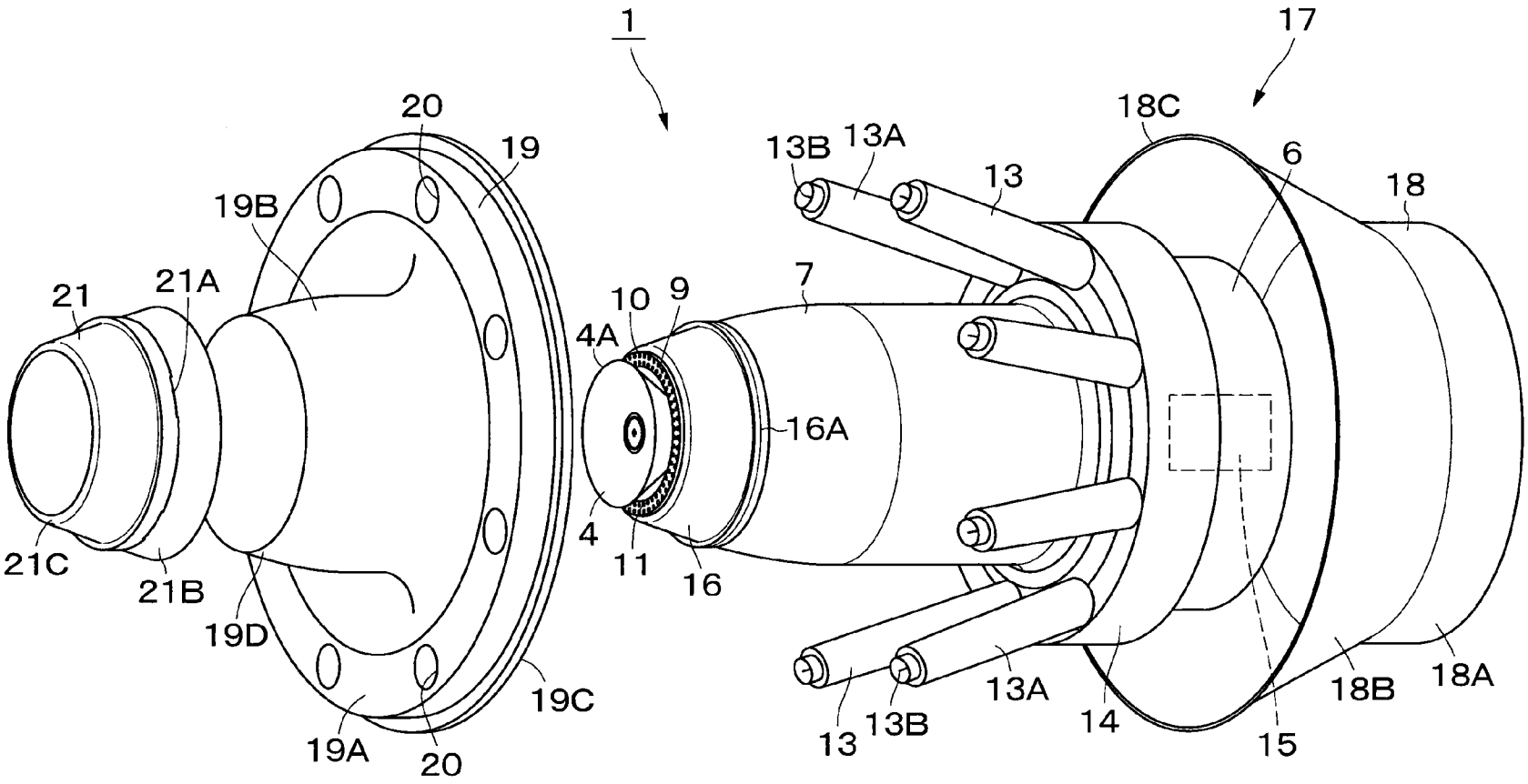
FIG. 2 is an exploded perspective view showing a state where a rear cover, a front cover and a semi conductive member in the rotary atomizing head type coating apparatus in FIG. 1 are exploded.
Figure 3:
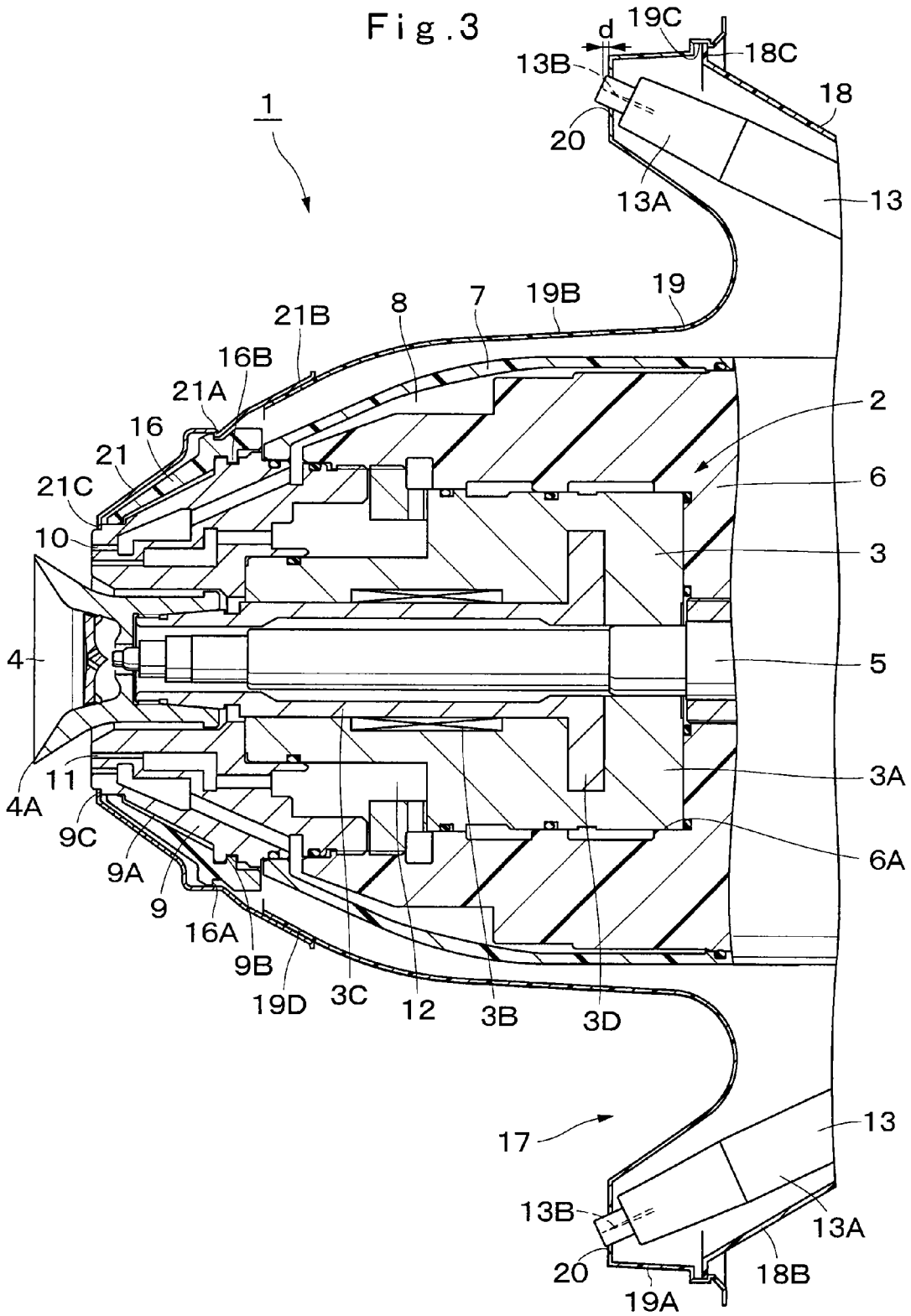
FIG. 3 is a cross sectional view showing the rotary atomizing head type coating apparatus in FIG. 1.

In the figure, designated at 1 is a rotary atomizing head type coating apparatus (hereinafter, referred to as coating apparatus 1) according to the first embodiment. As shown in FIG. 2 and FIG. 3, the rotary atomizing head coating apparatus 1 includes an atomizer 2, a housing member 6, a shaping air ring 6, external electrode units 13, a high voltage generator 15, a film cover 17, and a semi conductive member 21, which will be described later.

Indicated at 2 is the atomizer that atomizes paint toward an object to be coated (not shown) having an earth potential. The atomizer 2 includes an air motor 3 and a rotary atomizing head 4, which will be described later.

The air motor 3 drives the rotary atomizing head 4 for rotation, and the air motor 3 is made of a conductive metallic material such as an aluminum alloy, and is connected to ground. As shown in FIG. 3, the air motor 3 includes a motor housing 3A, a hollow rotary shaft 3C rotatably supported in the motor housing 3A through a static pressure air bearing 3B, and an air turbine 3D fixed to a base end side of the rotary shaft 3C. The air motor 3 supplies drive air to the air turbine 3D to rotate the rotary shaft 3C and the rotary atomizing head 4 in a high-speed of, such as 3000 to 150000 rpm.

The rotary atomizing head 4 is rotatably provided on the front side of the air motor 3. That is, the rotary atomizing head 4 is mounted to a front end side of the rotary shaft 3C of the air motor 3. The rotary atomizing head 4 is formed of a conductive metallic material such as an aluminum alloy, and is connected to ground through the air motor 3. The rotary atomizing head 4 is provided with a paint releasing edge 4A formed therein to be positioned in a front end part of the outer peripheral side for releasing paint. Therefore, in a state where the rotary atomizing head 4 is rotated in a high speed by the air motor 3, when the paint is supplied to the rotary atomizing head 4 through a feed tube 5 to be described later, the rotary atomizing head 4 atomizes the paint from the paint releasing edge 4A by a centrifugal force.

The feed tube 5 is provided to be inserted in the rotary shaft 3C, and a front end side of the feed tube 5 projects from a front end of the rotary shaft 3C and extends into the rotary atomizing head 4. A paint passage (not shown) is provided in the feed tube 5, and the paint passage is connected to a paint supply source and a washing fluid supply source (none of them are shown) through a color change valve device and the like. Thereby, the feed tube 5 supplies paint from the paint supply source through the paint passage to the rotary atomizing head 4 at coating. On the other hand, the feed tube 5 supplies washing fluids (thinner, air or the like) from a washing fluid supply source toward the rotary atomizing head 4 at washing or color changing.

The housing member 6 accommodates the air motor 3 therein, and the rotary atomizing head 4 is arranged on a front end side thereof. The housing member 6 is formed in a substantially columnar shape by, for example, an insulating resin material. A motor accommodating hole 6A accommodating the air motor 3 is formed on the front side of the housing member 6. The motor housing 3A is mounted in the motor accommodating hole 6A, and thereby the air motor 3 is supported to the housing member 6.

The air passage member 7 is provided to cover an outer peripheral surface in a front side part of the housing member 6. The air passage member 7 is formed in a cylindrical shape using, for example, an insulating resin material similar to that of the housing member 6. A first air passage 8 is formed between the air passage member 7 and the housing member 6 to supply first shaping air.

Indicated at 9 is the shaping air ring that spouts shaping air toward the outer peripheral surface of the rotary atomizing head 4. The shaping air ring 9 is provided on a front end side of the housing member 6 to be positioned backward of the rotary atomizing head 4. The shaping air ring 9 is formed in a cylindrical shape by, for example, a conductive metallic material, and is connected to ground through the air motor 3. As a result, the shaping air ring 9 forms an earth member according to the present invention. It should be noted that the shaping air ring 9 may be directly connected to ground or indirectly connected to ground though a resistance.

Figure 4:
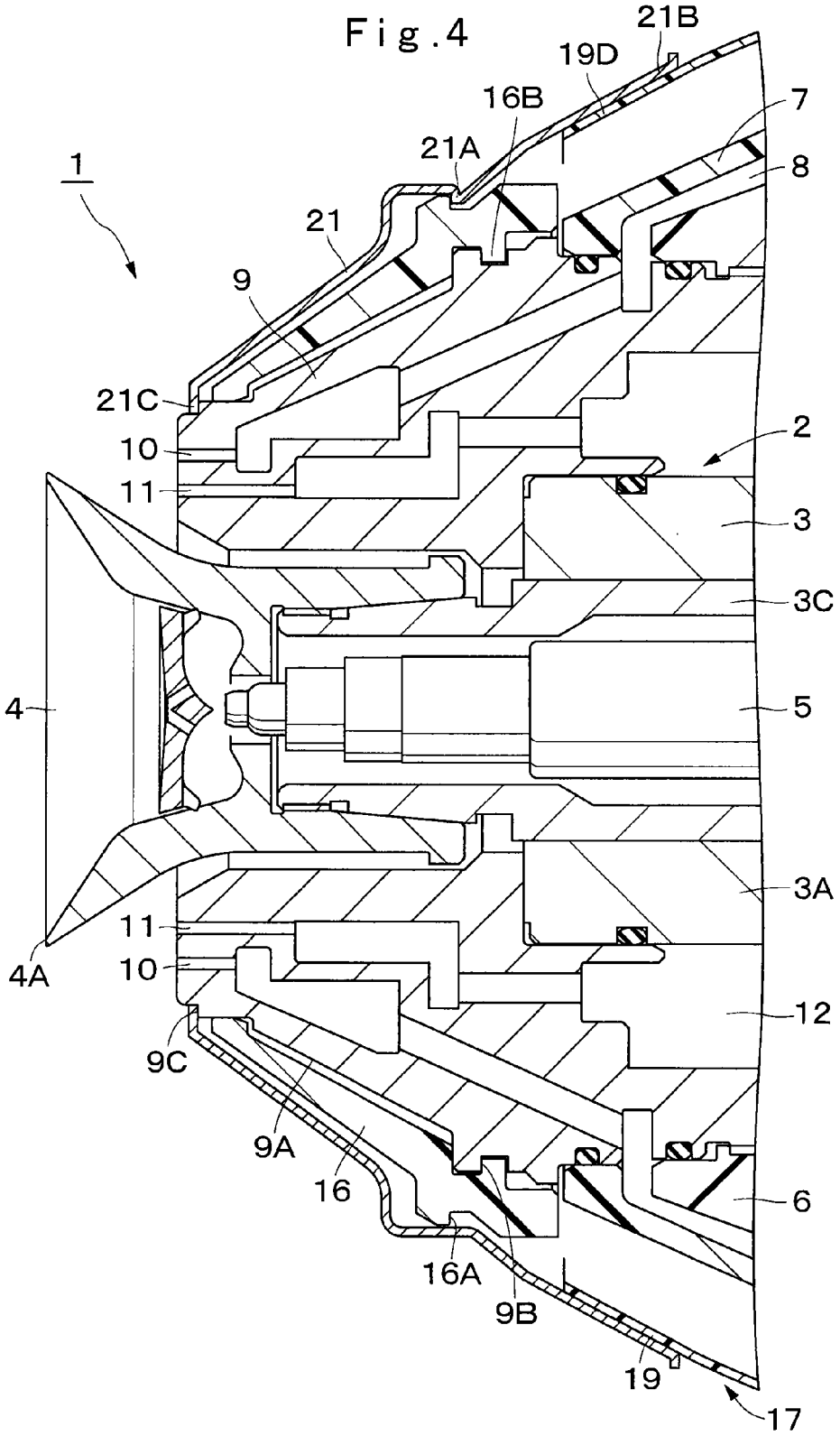
FIG. 4 is an enlarged cross sectional view of essential portions showing the periphery of a shaping air ring and a semi conductive member in FIG. 3 in an enlarging manner.
Figure 5:
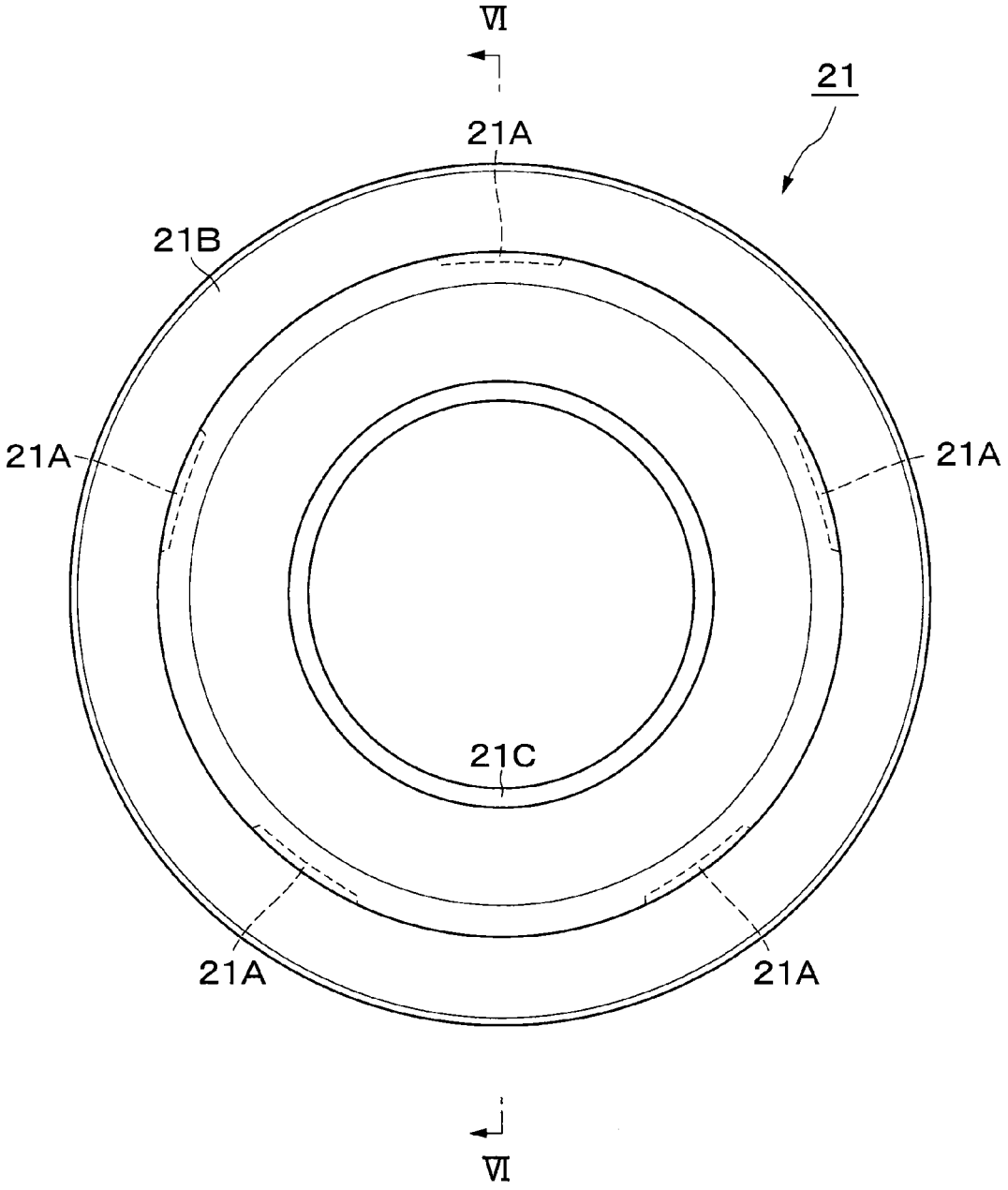
FIG. 5 is a front view showing the semi conductive member to be enlarged from the front side.
Figure 6:
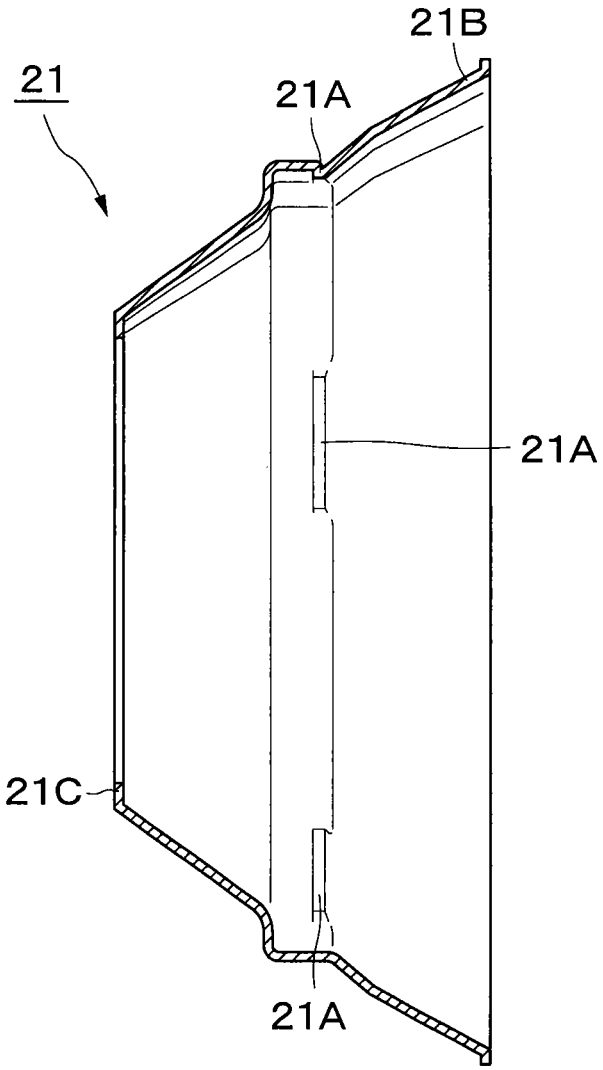
FIG. 6 is a cross sectional view showing the semi conductive member as viewed in a direction of arrows VI-VI in FIG. 5.

As shown in FIG. 4, a plurality of groove parts 9B are formed on the outer peripheral surface 9A of the shaping air ring 9 to mount an adaptor 16 thereto. The plurality of groove parts 9B are arranged to be spaced by equal intervals in the circumferential direction. A stepped part 9C is formed on a front end part of the shaping air ring 9 by protruding a radial inside part thereof to the forward side.

The shaping air ring 9 is provided with first air spout holes 10 and second air spout holes 11 formed therein. The first air spout holes 10 are arranged closer to a radial inside part (front side projecting part) than the stepped part 9C of the shaping air ring 9 and are provided along a paint releasing edge 4A of the rotary atomizing head 4. These first air spout holes 10 are arranged to line up annularly. Each of the first air spout holes 10 is communicated with the first air passage 8 provided between the housing member 6 and the air passage member 7. The first shaping air is supplied to each of the first air spout holes 10 through the air passage 8, and the air spout hole 10 spouts the first shaping air to the vicinity of the paint releasing edge 4A of the rotary atomizing head 4.

The second air spout holes 11 are formed in the shaping air ring 9 together with the first air spout holes 10. The second air spout holes 11 are respectively arranged closer to a radial inside than the first air spout holes 10 and are arranged to line up annularly. Each of the second air spout holes 11 is communicated with a second air passage 12 provided in the housing member 6. Thereby, the second shaping air having the same pressure as or a pressure different from the shaping air is supplied to the second air spout holes 11 through the air passage 12, and the second air spout hole 11 spouts the second shaping air to the back surface of the rotary atomizing head 4.

Thereby, the first and second shaping air shears liquid thread of paint released from the rotary atomizing head 4 to accelerate formation of paint particles, and shapes an atomizing pattern of paint particles atomized from the rotary atomizing head 4. At this time, the pressure of the first shaping air and the pressure of the second shaping air are adjusted as needed, thus making it possible to change the atomizing pattern to a desired size or shape.

Indicated at 13 are the external electrode units that are provided on the outer peripheral side of the housing member 6. As shown in FIG. 2, the external electrode units 13 are mounted to a collar-shaped support member 14 arranged on the rear side of the housing member 6. The support member 14 is formed by, for example, an insulating resin material as similar to that of the housing member 6, and projects to a radial outside from the housing member 6. For example, eight external electrode units 13 are provided to be spaced by equal intervals in the circumferential direction to be positioned in a projecting end side (outer diameter side) of the support member 14. These eight external electrode units 13 are annularly arranged coaxially with the rotary atomizing head 4, and are arranged along a circle around the rotary shaft 3C. It should be noted that not only the eight external electrode units 13 but also nine or more or seven or less external electrode units 13 may be adopted.

Here, the external electrode unit 13 includes an electrode support arm 13A extending in a long, bar-shape to the front side from the support member 14 and a needle electrode member 13B provided in a front end of the electrode support arm 13A. The electrode support arm 13A is formed using an insulating resin material as similar to, for example, the housing member 6 or support member 14, and its front end is arranged in a backward outer peripheral side of the rotary atomizing head 4 on the periphery of the rotary atomizing head 4. On the other hand, the needle electrode member 13B is formed in a needle shape using a conductive material such as metal to have a front end thereof as a free end, and is arranged in a shallow accommodation recessed part provided in a front end of the electrode support arm 13A. The needle electrode member 13B is connected to a high voltage generator 15 to be described later through a resistance (not shown) provided in the electrode support arm 13A.

The eight needle electrode members 13B are annually arranged coaxially with the rotary atomizing head 4, and are provided in a position along a large diameter circle having a large diameter dimension around the rotational shaft 13C.

The eight needle electrode members 13B are arranged on the rear side of the atomizer 2 than the shaping air ring 9. Therefore, the external electrode units 13 charge paint particles atomized from the rotary atomizing head 4 with a minus high voltage by generation of corona discharge from the needle electrode members 13B.

The high voltage generator 15 is connected to the external electrode unit 13, and the high voltage generator 15 forms a high voltage applying unit to the external electrode unit 13. The high voltage generator 15 is formed by, for example, a multiple stepped rectification circuit (what is called cock croft circuit), and is connected electrically to each needle electrode member 13B of the external electrode units 13. In addition, the high voltage generator 15 generates a high voltage of a direct current voltage of −10 kV to −150 kV, for example, and supplies this high voltage to each needle electrode member 13B of the external electrode units 13.

The adaptor 16 is provided in the shaping air ring 9, and the adaptor 16 is formed by an insulating material or semi conductive material. Specifically, the adaptor 16 is formed in a ring shape, and is mounted to the shaping air ring 9 to cover the outer peripheral surface 9A of the shaping air ring 9. A ring-shaped engaging groove part 16A is formed on an outer peripheral side of the adaptor 16 over an entire periphery for mounting the semi conductive member 21 to be described later.

Further, a plurality of projections 16B projecting toward a radial inside are provided on an inner peripheral side of the adaptor 16 in positions corresponding to the groove parts 9B of the shaping air ring 9. The plurality of projections 16B are arranged to be spaced by equal intervals in the circumferential direction.

When the adaptor 16 is mounted to the shaping air ring 9, the adaptor 16 is pushed into the outer peripheral side of the shaping air ring 9 from forward to backward, and the adaptor 16 is rotated by a predetermined angle in the circumferential direction in this state. Therefore, the projection 16B of the adaptor 16 is inserted in the groove part 9B of the shaping air ring 9 to cause both to be engaged with each other, thus mounting the adaptor 16 to the shaping air ring 9. The adaptor 16 can be removed from the shaping air ring 9 by the reverse operation to the above.

It should be noted that the adaptor 16 can be mounted to or removed from the shaping air ring 9 by an engaging mechanism composed of the projections 16B and the groove parts 9B. However, the present invention is not limited thereto, and the engaging mechanism may be configured such that a female screw is formed on an inner peripheral side of the adaptor 16 and a male screw is formed on an outer peripheral side of the shaping air ring 9 to screw the adaptor 16 and the shaping air ring 9 with each other for fixation. Further, if it is not necessary to remove the adaptor 16, the adaptor 16 may be fixed to the shaping air ring 9.

Designated at 17 is the film cover that covers the outer peripheral side of the air motor 3. The film cover 17 is formed using an insulating resin material, such as polypropylene (PP), polyethylene terephthalate (PET) or polyethylene (PE). The film cover 17 is formed by a resin film having a thickness dimension of 2 mm or less, preferably about 0.1 mm to 1.5 mm. For reducing the material cost, preferably the thickness dimension of the film cover 17 is as thin as possible within a range where a mechanical strength of the film cover 17 can be secured. Here, the film cover 17 includes a cylindrical rear cover 18 that is mounted to the housing member 6 and a cylindrical front cover 19 that is mounted on the front side of the rear cover 18 to cover the air motor 3.

A material of the film cover 17 has flame retardation and self-extinguishing properties, and is selected as needed in consideration of workability and solvent resistance. Considering a case of vacuum-molding the film cover 17, when water-based paint is used, it is preferable to use, for example, polyvinyl chloride (PVC), and when solvent-based paint is used, it is preferable to form the film cover 17 with a material excellent in solvent resistance, such as polypropylene (PP).

The rear cover 18 is provided with a fixing part 18A that is formed in a cylindrical shape and is fixed to the housing member 6 and a flared part 18B that extends to flare in a bell shape forward from a front end of the fixing part 18A. The fixing part 18A is mounted on an outer peripheral side of the support member 14 using a fixing means (not shown) such as a bolt or lock pin and is fixed to the housing member 6. At this time, eight electrode support arms 13A are arranged inside the flared part 18B. Further a flange part 18C that spreads radially outward is provided in a front side opening end of the flared part 18B.

The front cover 19 is provided with a disc part 19A that is positioned in a rear part outer peripheral side and is formed in a disc shape and a cylindrical part 19B that is successively formed to an inner peripheral edge of the disc part 19A to extend forward. The disc part 19A is provided with electrode openings 20 formed in positions corresponding to front end parts of the external electrode units 13. The needle electrode member 13B of the external electrode unit 13 is exposed to the front side from the electrode opening 20. As shown in FIG. 3, preferably the front end of the needle electrode member 13B projects having a projection dimension d of about 1 mm to 10 mm from the electrode opening 20, for example.

An annular combining groove part 19C is formed on a rear side opening end of the disc part 19A to extend over the entire circumference to be positioned on the inner peripheral side. The flange part 18C of the rear cover 18 is inserted in the combining groove part 19C. As a result, the front cover 19 is attached to the front side of the rear cover 18. On the other hand, the flange part 18C of the rear cover 18 is flexibly deformed by pulling the front cover 19 forward, thus making it possible to separate the flange part 18C from the combining groove part 19C. Thereby, the front cover 19 can be removed from the rear cover 18.

The cylindrical part 19B covers the outer peripheral side of the air motor 3 including the housing member 6 and the air passage member 7. A front end part 19D of the cylindrical part 19B is arranged near the rear end of the shaping air ring 9 to be positioned to be radially spaced from the shaping air ring 9. That is, the film cover 17 is not in contact with the shaping air ring 9, and a radial or axial gap is formed between the film cover 17 and the shaping air ring 9.

Designated at 21 is the semi conductive member formed of a semi conductive material. The semi conductive member 21 is formed of a semi conductive resin material having a surface resistance of $10^{10}$ to $10^{7}$ Ωm or volume resistance of $10^{8}$ to $10^{5}$ Ωm, for example. Specifically, the semi conductive member 21 is formed using a semi conductive resin sheet in which a semi conductive resin is kneaded in amorphous-polyethylene terephthalate (A-PET), a three-layered resin film in which a polystyrene semi conductive film is interposed between two polypropylene (PP) films or the like. The semi conductive member 21 has a thickness dimension of, for example, 2 mm or less, preferably about 0.1 mm to 1.5 mm, and flares from forward to backward to be formed in a substantially conical shape or in a substantially cylindrical shape. It should be noted that the semi conductive member 21 may be formed, for example, by a resin material having semi conductivity by blending a conductive element with the same resin material as that of the film cover 17.

A plurality (for example, five) of engaging projections 21A are formed in the intermediate position of the semi conductive member 21 in the front-rear direction to project toward a radial inside. The plurality of engaging projections 21A extend in an arc shape along the engaging groove parts 16A of the adaptor 16 in the circumferential direction, and are arranged to be spaced by equal intervals from each other in the circumferential direction. When the semi conductive member 21 is pushed against the adaptor 16 from forward to backward, the plurality of engaging projections 21A are inserted in the engaging groove part 16A of the adaptor 16. Thereby, the semi conductive member 21 is mounted to the outer peripheral side of the adaptor 16. When the semi conductive member 21 is pulled forward, the engaging projection 21A is flexibly deformed to pull the engaging projection 21A out of the engaging groove part 16A. Thereby, the semi conductive member 21 can be removed from the adaptor 16.

A rear end part 21B that is one end part of the semi conductive member 21 is in contact with the front end part 19D of the front cover 19. Specifically, the rear end part 21B of the semi conductive member 21 covers the front end part 19D of the front cover 19 from outside to be in surface contact with the front end part 19D, and the semi conductive member 21 can be conductive to the front cover 19.

On the other hand, a front end part 21C that is the other end part of the semi conductive member 21 is in contact with the shaping air ring 9. Specifically, the front end part 21C of the semi conductive member 21 is formed as a ring-shaped flat plate extending radially inside, is in surface contact with an end surface of the stepped part 9C provided on a front outer peripheral side of the shaping air ring 9, and the semi conductive member 21 can be conductive to the shaping air ring 9.

It should be noted that the rear end part 21B of the semi conductive member 21 is in surface contact with the front end part 19D of the front cover 19, and the front end part 21C of the semi conductive member 21 is in surface contact with the stepped part 9C of the shaping air ring 9. However, the present invention is not limited thereto, and only if the rear end part 21B of the semi conductive member 21 and the front end part 19D of the front cover 19 are electrically connected to each other, they may be in line contact or in point contact. Similarly, the front end part 21C of the semi conductive member 21 may be in line contact or point contact with the stepped part 9C of the shaping air ring 9. For increasing an electrical resistance of the semi conductive member 21 between the shaping air ring 9 and the front cover 19, the front end and the rear end of the semi conductive member 21 is preferably in line contact or point contact with each other. On the other hand, for securing the electrical connection, the semi conductive member 21 is preferably in surface contact with the shaping air ring 9 or the front cover 19.

The coating apparatus 1 according to the first embodiment has the aforementioned configuration, and next an explanation will be made of an operation at the time of performing a coating work using the coating apparatus 1.

First, the rotary atomizing head 4 is rotated at a high speed by the air motor 3, and the paint is supplied to the rotary atomizing head 4 through the feed tube 5 at this state. Therefore, the atomizer 2 micro-particulates the paint by a centrifugal force when the rotary atomizing head 4 rotates, and atomizes the paint as the paint particles. At this time, the first and second shaping air is supplied from the first and second air spout holes 10, 11 provided in the shaping air ring 9, and the shaping air controls an atomizing pattern composed of the paint particles.

Here, a minus high voltage is applied to the needle electrode member 13B of the external electrode unit 13 by the high voltage generator 15. Therefore, an electrostatic field is regularly formed between the needle electrode member 13B and the object to be coated having the earth potential. Therefore, corona discharge is generated in the front end of the needle electrode member 13B to generate the ionization zone caused by the corona discharge in the periphery of the rotary atomizing head 4. As a result, the paint particles atomized from the rotary atomizing head 4 pass through the ionization zone, and thereby are indirectly charged with a high voltage. The paint particles charged with the high voltage (charged paint particles) fly along the electrostatic field formed between the needle electrode member 13B and the object to be coated and adhere to the object to be coated for paint.

Next, an explanation will be made of effects of suppressing degradation, contamination or the like of the film cover 17 by the semi conductive member 21.

Here, a description will be made of a case of omitting the semi conductive member 21, for example. In this case, a surface of the film cover 17 made of the insulating material collides with ions from the external electrode unit 13 for charge to increase the electrical potential. At this time, when a difference in electrical potential between the charged film cover 17 and the grounded shaping air ring 9 increases and thus the insulating state cannot be maintained, the discharge is generated. Several micro seconds of pulse discharge is generated in air to release energy accumulated by the charging in a short time.

Thereby, collision of electrons by the discharging, local heat generation of joule by electrical current, generation of ozone by plasma, release of electromagnetic wave by transition from energized state to base state, and the like are generated. Oxidation or reduction of molecular weight is generated in peripheral materials such as the film cover 17 by these phenomena and the materials are degraded. Particularly, since in the shaping air ring 9 or rotary atomizing head 4, the electrical potential is fixed to the earth potential and an electrical line of force is pulled in from the external electrode unit 13, ion particles concentrate thereon. As a result, the front end part 19D of the film cover 17 near the shaping air ring 9 and the rotary atomizing head 4 is more easily charged than other parts and is remarkable in degradation progress.

In contrast to this, in the first embodiment, the boundary between the front end part 19D of the film cover 17 made of an insulating material and the shaping air ring 9 made of a conductive material is covered with the semi conductive member 21. Thereby, the rear end part 21B of the semi conductive member 21 is made in contact with the front end part 19D of the film cover 17 and the front end part 21C of the semi conductive member 21 is made in contact with the stepped part 9C of the shaping air ring 9, which will be connected to ground.

In this case, the electric charge made to the film cover 17 is discharged to the semi conductive member 21, but the electrical current does not become intensively large for a short time, as in the case of discharge to the shaping air ring 9 made of the conductive material, and becomes slow electrical current. Therefore, degradation of the film cover 17 is suppressed. On the other hand, the electrical current flows also in the semi conductive member 21 following the discharge from the film cover 17, but this electrical current becomes several ten μA or less. Therefore, there is no possibility that the semi conductive member 21 itself may be eventually degraded due to supply of the electrical current thereto.

Further, since the shaping air ring 9 has an earth potential, ions from the external electrode unit 13 tend to easily concentrate on the semi conductive member 21 in contact with the shaping air ring 9. However, since the semi conductive member 21 is a resistance having a higher volume resistance or a higher surface resistance as compared to that of a metallic material, an electrical potential gradient is formed in the semi conductive member 21, an electrical potential of which becomes in a higher state as compared to that of the shaping air ring 9. At this time, since the semi conductive member 21 takes charge with the same polarity as the charged paint particle, the charged paint particle becomes difficult to adhere thereto as compared to the shaping air ring 9, making it possible to suppress the contamination.

Thus, according to the first embodiment, the rear end part 21B of the semi conductive member 21 is made in contact with the film cover 17 and the front end part 21C of the semi conductive member 21 is made in contact with the shaping air ring 9. Therefore, the discharge between the film cover 17 and the shaping air ring 9 is prevented by the semi conductive member 21 to suppress degradation of the film cover 17, thus making it possible to enhance the durability. In addition thereto, since the semi conductive member 21 takes charge with the same polarity as the charged paint particle, the adhesion of the charged paint particle can be suppressed.

Since the shaping air ring 9 is connected to ground, it is not necessary to provide another member only for grounding the front end part 21C of the semi conductive member 21. Further, since the discharge is generated also in the periphery of the grounded shaping air ring 9, ions can be supplied in the periphery of the air spout holes 10, 11 to accelerate charge of paint particles through the shaping air.

The adaptor 16 made of an insulating material or semi conductive material is provided in the shaping air ring 9. Thereby, even when the front end part 19D of the film cover 17 is arranged in the periphery of the shaping air ring 9, insulation properties between the film cover 17 and the shaping air ring 9 can be enhanced to suppress direct discharge therebetween.

On the other hand, since the front end part 21C of the semi conductive member 21 is in electrical contact with the shaping air ring 9, the semi conductive member 21 has the electrical potential closer to earth than the film cover 17, and paint particles tend to easily adhere thereto. However, since the semi conductive member 21 is replaceably mounted to the adaptor 16, only the semi conductive member 21 that tends to be easily contaminated can be replaced to enhance the maintenance properties.

Since the needle electrode member 13B of the external electrode unit 13 is exposed from the electrode opening 20 formed in the film cover 17, ions from the needle electrode member 13B can be supplied to the paint particles. Since the film cover 17 covers the electrode support arm 13A of the external electrode unit 13 in addition to the air motor 3, the film cover 17 can prevent the contamination of the electrode support arm 13A and keep it clean.

Further, the film cover 17 is configured of the cylindrical rear cover 18 mounted to the housing member 6 and the cylindrical front cover 19 mounted on the front side of the rear cover 18 to cover the air motor 3. Thereby, even if the paint particle adheres to the film cover 17, the film cover 17 can be removed from the housing member 6 by separating the front cover 19 from the rear cover 18. Therefore, the film cover 17 can be easily replaced to enhance the maintenance properties.

Figure 7:
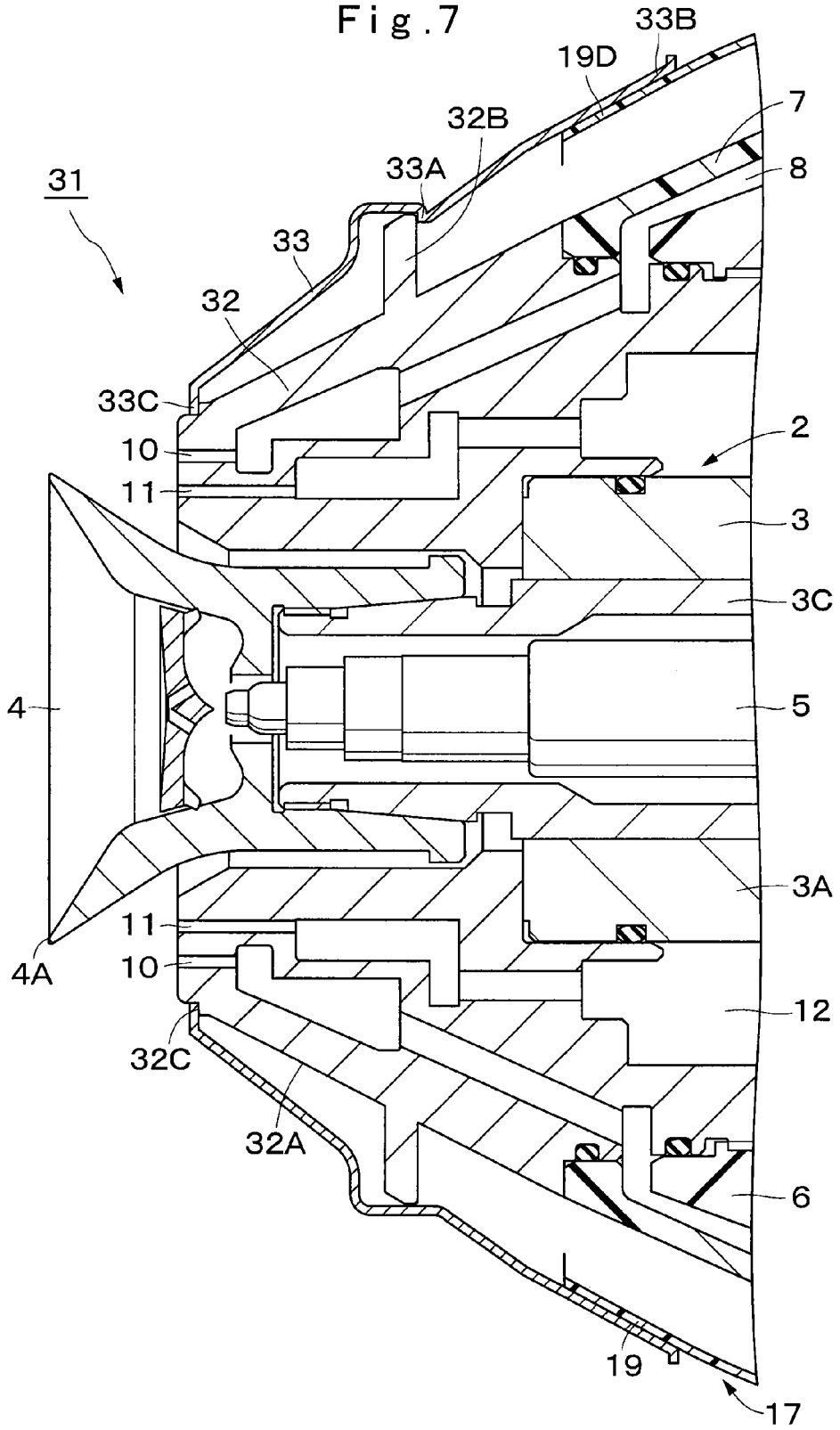
FIG. 7 is an enlarged cross sectional view of essential portions showing a rotary atomizing head type coating apparatus according to a second embodiment in a position similar to that of FIG. 4.

Next, FIG. 7 shows a second embodiment of an electrostatic coating apparatus according to the present invention. The second embodiment is characterized in that a shaping air ring is provided with an inside engaging part, and an outside engaging part engaging with the inside engaging part is provided in the midway part between one end part and the other end part of a semi conductive member. In the second embodiment, the component elements that are identical to those of the foregoing first embodiment will be simply denoted by the same reference numerals to avoid repetitions of similar explanations.

Designated at 31 is a rotary atomizing head type coating apparatus (hereinafter, referred to as coating apparatus 31) according to the second embodiment. The coating apparatus 31 includes, as substantially similar to the coating apparatus 1 according to the first embodiment, an atomizer 2, a housing member 6, a shaping air ring 32, external electrode units 13, a high voltage generator 15, a film cover 17, a semi conductive member 33 and the like.

Indicated at 32 is the shaping air ring according to the second embodiment. The shaping air ring 32 is formed as substantially similar to the shaping air ring 9 according to the first embodiment, and is provided with first and second air spout holes 10, 11. On the other hand, the shaping air ring 32 forms part of the earth member. Therefore, the shaping air ring 32 is formed in a cylindrical shape using, for example, a conductive metallic material, and is connected to ground through the air motor 3.

An annular flange part 32B is formed on an outer peripheral surface 32A of the shaping air ring 32 to project radially outside. The flange part 32B is arranged in a position opposed to the midway part between a rear end part 33B and a front end part 33C of the semi conductive member 33 to be described later. That is, the flange part 32B forms an inside engaging part engaging with an engaging projection 33A. It should be noted that for preventing discharge between the front end part 19D of the front cover 19 and the flange part 32B, for example, the flange part 32B is preferably arranged in a position closer to a stepped part 32C than the front end part 19D.

Indicated at 33 is the semi conductive member according to the second embodiment that is formed by a semi conductive material. The semi conductive member 33 is formed as substantially similar to the semi conductive member 21 according to the first embodiment. Therefore, the semi conductive member 33 flares from forward to backward to be formed in a substantially conical shape or substantially cylindrical shape.

A plurality (for example, five) of engaging projections 33A are formed in the intermediate position of the semi conductive member 33 in the front-rear direction of the semi conductive member 33 to project radially inside. The plurality of engaging projections 33A form an outside engaging part engaging with the flange part 32B of the shaping air ring 32. Specifically, the plurality of engaging projections 33A extend in an arc shape along the flange part 32B of the shaping air ring 32 toward the circumferential direction, and are arranged to be spaced by equal intervals from each other in the circumferential direction.

A rear end part 33B that is one end part of the semi conductive member 33 is in contact with the front end part 19D of the front cover 19, and the semi conductive member 33 can be electrically conductive to the front cover 19. Specifically, the rear end part 33B of the semi conductive member 33 covers the front end part 19D of the front cover 19 from outside to be in surface contact with the front end part 19D of the front cover 19, and the semi conductive member 33 can be electrically conductive to the front cover 19.

On the other hand, a front end part 33C that is the other end part of the semi conductive member 33 is in contact with the shaping air ring 32. Specifically, the front end part 33C of the semi conductive member 33 is formed as a ring-shaped flat plate extending radially inside, is in surface contact with an end surface of the stepped part 32C provided on a front outer peripheral side of the shaping air ring 32, and the semi conductive member 33 can be electrically conductive to the shaping air ring 32.

When the semi conductive member 33 is pushed against the shaping air ring 32 from forward to backward, the plurality of engaging projections 33A run over the flange part 32B to be locked on a rear surface of the flange part 32B. At this time, the front end part 33C of the semi conductive member 33 is in surface contact with the end surface of the stepped part 32C of the shaping air ring 32. Therefore, the flange part 32B and the stepped part 32C of the shaping air ring 32 are interposed in the front-rear direction between the engaging projection 33A and the front end part 33C of the semi conductive member 33. As a result, the semi conductive member 33 is mounted to the outer peripheral side of the shaping air ring 32.

On the other hand, when the semi conductive member 33 is pulled forward, the engaging projection 33A is flexibly deformed and the engaging projection 33A is pulled out of the flange part 32B. Thereby, the semi conductive member 33 can be removed from the shaping air ring 32.

Thus, also in the second embodiment as configured above, operational effects substantially similar to those in the first embodiment can be obtained. Particularly, in the second embodiment, since the flange part 32B is provided in the shaping air ring 32 and the engaging projection 33A is provided in the semi conductive member 33, the semi conductive member 33 can be replaceably mounted to the shaping air ring 32 in a state where the engaging projection 33A is engaged with the flange part 32B. Therefore, only the semi conductive member 33 that tends to be easily contaminated can be replaced. In addition, the adaptor 16 can be eliminated in contrast to the first embodiment, making it possible to reduce manufacturing costs.

Figure 8:
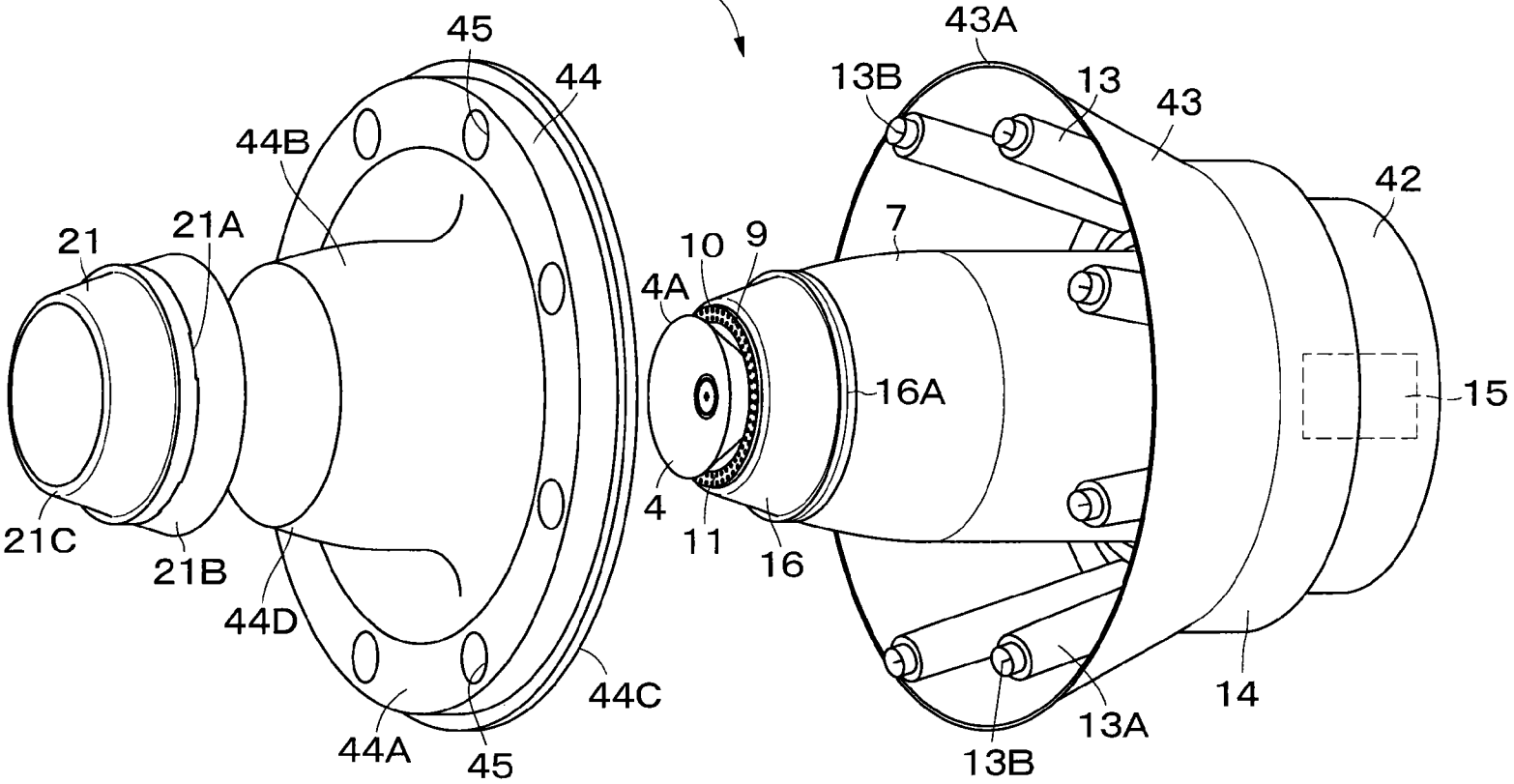
FIG. 8 is an exploded perspective view showing a front cover and a semi conductive member in a rotary atomizing head type coating apparatus according to a third embodiment.
Figure 9:
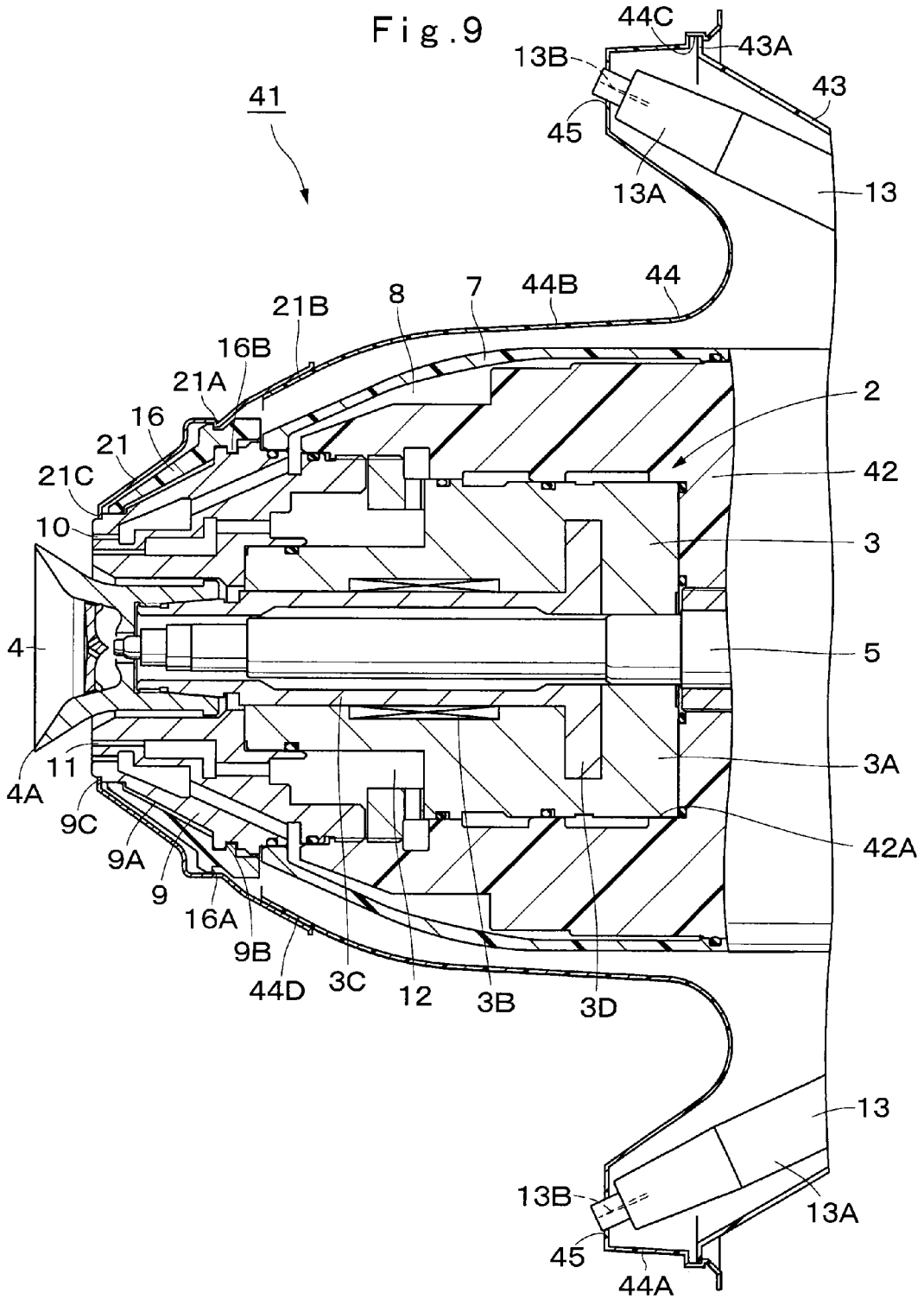
FIG. 9 is a cross sectional view showing the rotary atomizing head type coating apparatus according to the third embodiment in a position similar to that of FIG. 3.

Next, FIG. 8 and FIG. 9 show a third embodiment of an electrostatic coating apparatus according to the present invention. The third embodiment is characterized in that a film cover is configured of a cylindrical front cover mounted to the front side of an electrode cover part of a housing member. In the third embodiment, the component elements that are identical to those of the foregoing first embodiment will be simply denoted by the same reference numerals to avoid repetitions of similar explanations.

Designated at 41 is a rotary atomizing head type coating apparatus (hereinafter, referred to as coating apparatus 41) according to the third embodiment. The coating apparatus 41 includes, as substantially similar to the coating apparatus 1 according to the first embodiment, an atomizer 2, a housing member 42, a shaping air ring 9, external electrode units 13, a high voltage generator 15, a front cover 44, a semi conductive member 21 and the like.

Indicated 42 is the housing member according to the third embodiment in which the air motor 3 is accommodated and the rotary atomizing head 4 is arranged on the front side thereof. The housing member 42 is formed as substantially similar to the housing member 6 according to the first embodiment. Therefore, the air motor 3 is accommodated in a motor accommodating hole 42A of the housing member 42 to be supported to the housing member 42.

A support member 14 that supports the external electrode units 13 is provided on a backward of the housing member 42. The support member 14 is provided with an electrode cover part 43 that covers all the external electrode units 13 from a radial outside. The electrode cover part 43 surrounds all the external electrode units 13 and flares in a bell shape forward from a front end of the support member 14 for extension. A flange part 43A is provided in a front side opening end of the electrode cover part 43 to spread toward a radial outside.

The front cover 44 forms a film cover used in the third embodiment. Specifically, the front cover 44 is formed as substantially similar to the front cover 19 according to the first embodiment. Therefore, the front cover 44 includes a disc part 44A formed in a disc shape to be positioned in a rear part outer peripheral side and a cylindrical part 44B that is formed to be in series with an inner peripheral edge of the disc part 44A and extends forward. The disc part 44A is provided with electrode openings 45 formed in positions corresponding to front end parts of the external electrode units 13. The needle electrode member 13B of the external electrode unit 13 is exposed from the electrode opening 45.

The cylindrical part 44B covers an outer peripheral side of the air motor 3 including the housing member 42 and the air passage member 7. The front end part 44D of the cylindrical part 44B is arranged in the rear end periphery of the shaping air ring 9 at a position spaced apart from the shaping air ring 9 and is in contact with the rear end part 21B of the semi conductive member 21, which will be electrically conductive thereto.

An annular combining groove part 44C is formed on a rear side opening end of the disc part 44A to be positioned in the inner peripheral side and extend over an entire periphery thereof. At the time of pressing the front cover 44 against the electrode cover part 43 from the front side, the flange part 43A is inserted in the combining groove part 44C. Thereby, the front cover 44 is attached to the front side of the electrode cover part 43. On the other hand, when the front cover 44 is pulled forward, the flange part 43A is flexibly deformed and the flange part 43A is pulled out of the combining groove part 44C. Thereby, the front cover 44 can be removed from the housing member 42.

Thus, also in the third embodiment as configured above, operational effects substantially similar to those in the first embodiment can be obtained. Particularly, in the third embodiment, the film cover is configured by the front cover 44 mounted to the front side of the electrode cover part 43 of the housing member 42. Therefore, even if the paint particle adheres to the front cover 44, the front cover 44 can be removed from the housing member 42 by separating the front cover 44 from the electrode cover part 43. As a result, the front cover 44 can be easily replaced to enhance the maintenance properties.

Here, the rear end part of the housing member 42 is generally mounted to a robot, a reciprocator or the like. Therefore, as in the case of the first embodiment, in a case where the rear cover 18 is provided to be positioned backward of the external electrode unit 13, it is necessary to remove the coating apparatus 1 from the robot or the like at the time of replacing the rear cover 18. In contrast to this, in the third embodiment, the film cover is configured of the front cover 44 positioned on the front side of the external electrode unit 13 and the back side of the external electrode unit 13 is covered with the electrode cover part 43 mounted fixedly to the housing member 42. Therefore, the front cover 44 can be replaced in a state where the coating apparatus 41 is mounted to the robot or the like, and the maintenance properties can be enhanced by separately washing the electrode cover part 43 to which contamination is difficult to adhere.

It should be noted that the third embodiment is explained by taking a case where the coating apparatus is applied to the first embodiment, as an example, but the third embodiment may be applied to the second embodiment.

In the third embodiment, the electrode cover part 43 is provided separately from the electrode support arm 13A of the external electrode unit 13, but the electrode support arm and the electrode cover part may be integrally formed.

On the other hand, in the respective aforementioned embodiments, a case where five engaging projections 21A of the semi conductive member 21 and five engaging projections 33A of the semi conductive member 33 are respectively provided to be spaced in the circumferential direction is explained as an example, but two, three, four, six or more engaging projections may be provided. Further, for example, one engaging projection may be formed over an entire circumference to project in an annular shape or in a C-letter shape.

In the first and third embodiments, the semi conductive member 21 is replaceably mounted to the adaptor 16 provided in the shaping air ring 9. However, the present invention is not limited thereto, and, for example, the semi conductive member may be formed by integration of the semi conductive member 21 and the adaptor 16. In this case, the semi conductive member integral with the adaptor may be replaceably mounted to the shaping air ring.

In the first embodiment, the rear end part 21B of the semi conductive member 21 is made in contact with the front cover 19 of the film cover 17 and the front end part 21C of the semi conductive member 21 is made in contact with the shaping air ring 9. However, the present invention is not limited thereto, and, for example, the semi conductive member may be formed as an annular plate body extending radially, wherein a radial outside end part thereof is made in contact with a film cover and a radial inside end part thereof is made in contact with a shaping air ring. That is, when the film cover and the earth member are electrically connected using the semi conductive member, positions of one end part and the other end part of the semi conductive member can be set as needed. This configuration can be applied to the second and third embodiments.

In the first embodiment, the semi conductive member 21 is in contact with the film cover 17 in a separable state, but, for example, the semi conductive member may be connected or adhere to the film cover in an inseparable state or may be formed integrally. In this case, a contact failure between the semi conductive member and the film cover can be prevented. This configuration can be applied to the second and third embodiments.

The first embodiment is explained by taking a case where the shaping air ring 9 forms the earth member, as an example. However, the present invention is not limited thereto, and, for example, the earth member may be provided separately from the shaping air ring, wherein the semi conductive member is connected to ground through the earth member. This configuration can be applied to the second and third embodiments.

In each of the aforementioned embodiments, a case where the needle electrode member 13B is arranged on the rear side of the atomizer 2 is illustrated, however, it may be arranged on the front side of the atomizer 2. For accelerating supply of ions to the paint particle, the needle electrode member 13B is preferably arranged on the front side of the atomizer 2. On the other hand, for downsizing the coating apparatus 1, 31 or 41, the needle electrode member 13B is preferably arranged on the rear side of the atomizer 2.

In each of the aforementioned embodiments, a case where the electrode support arm 13A made of the long bar-shaped body of the external electrode unit 13 is provided in the collar-shaped support member 14 arranged on the rear side of the housing member 6 is illustrated. However, the present invention is not limited thereto, and there may be adopted the configuration that the support member 14 is formed as a cylindrical support member extending to the air passage member 7 or the rotary atomizing head 4 and a short electrode support arm is provided in a front end of this cylindrical support member.

In each of the aforementioned embodiments, the rotary atomizing head 4 is formed at its entity by the conductive material. However, the present invention is not limited thereto, and there may be adopted the configuration that, for example, as in the case of the rotary atomizing head described in Patent Document 2, the body part having the substantially same shape as the rotary atomizing head 4 is formed using an insulating material, and a conductive or semi conductive coated layer is provided on an outside surface and an inside surface of the body part. In this case, a paint release edge of the rotary atomizing head is connected to ground through the coated layer.

In each of the aforementioned embodiments, the external electrode unit 13 is formed using the needle electrode member 13B. However, the present invention is not limited thereto, and an external electrode member may be formed using a ring electrode that surrounds an outer peripheral side of a cylindrical part of a front cover and is annularly formed with an elongated conductive wire. Besides, an external electrode unit may be formed using a blade ring in a thin blade shape, a star-shaped ring formed in a star shape with an elongated conductive wire, a spiral ring formed spirally with an elongated conductive wire or the like, which are described in Patent Document 1.

In each of the aforementioned embodiments, each of the housing members 6, 42 and the air passage member 7 are separately provided, but the housing member and the air passage member may be formed integrally using an insulating material.

In each of the aforementioned embodiments, the motor is explained by taking the air motor as an example, but, for example, an electric motor may be used.

Further, in each of the aforementioned embodiments, the first and second air spout holes 10, 11 that spout the shaping air are arranged in a double-annular shape in each of the shaping air rings 9, 32. However, the present invention is not limited thereto, and, for example, the air spout hole may be arranged in a single annular shape by eliminating any one of the first and second air spout holes, for example.

DESCRIPTION OF REFERENCE NUMERALS

1, 31, 41: Rotary atomizing head type coating apparatus (Coating apparatus)
3: Air motor (Motor)
3C: Rotary shaft
4: Rotary atomizing head

4A: Paint release edge
6, 42: Housing member
9, 32: Shaping air ring (Earth member)
10: First air spout hole
11: Second air spout hole
13: External electrode unit
13A: Electrode support arm
13B: Needle electrode member
15: High voltage generator (High voltage applying unit)
16: Adaptor
17: Film cover
18: Rear cover
19, 44: Front cover
19D, 44D: Front end part
20, 45: Electrode opening
21, 33: Semi conductive member
21A, 33A: Engaging projection (Outside engaging part)
21B, 33B: Rear end part (One end part)
21C, 33C: Front end part (Other end part)
32B: Flange part (Inside engaging part)
43: Electrode cover part
43A: Flange part

The invention claimed is:

1. An electrostatic coating apparatus comprising:

a motor;

a rotary atomizing head that is provided on a front side of said motor to be rotatable by said motor;

an external electrode unit that is provided in the periphery of said rotary atomizing head; and a high voltage applying unit that applies a high voltage to said external electrode unit to indirectly charge paint particles atomized from said rotary atomizing head with the high voltage, wherein an earth member that is provided on the rear side of said rotary atomizing head, the earth member to be connected to ground and have the earth potential;

a film cover that is formed by an insulating material and covers an outer peripheral side of said motor in such a manner to form a gap between said earth member and said film cover itself; and a semi conductive member that is formed by a semi conductive material and flares from forward to backward to be formed in a substantially conical shape or in a substantially cylindrical shape, wherein a rear end part of the semi conductive member is in contact with said film cover and a front end part of the semi conductive member is in contact with said earth member.

2. The electrostatic coating apparatus according to claim 1, wherein the earth member is a shaping air ring in which an air spout hole for spouting shaping air is formed, and wherein said shaping air ring is formed of a conductive material.

3. The electrostatic coating apparatus according to claim 2, wherein said shaping air ring is provided with an adaptor made of an insulating material or semi conductive material, and said semi conductive member is replaceably mounted to said adaptor.

4. The electrostatic coating apparatus according to claim 2, wherein said shaping air ring is provided with an inside engaging part in a position opposed to the midway part between the front end part and the rear end part of said semi conductive member, and said semi conductive member is provided with an outside engaging part engaging with said inside engaging part of said shaping air ring, wherein said semi conductive member is replaceably mounted to said shaping air ring in a state where said outside engaging part is engaged with said inside engaging part.

5. The electrostatic coating apparatus according to claim 1, wherein said external electrode unit includes an electrode support arm, and a needle electrode member that is provided in said electrode support arm and to which a high voltage is applied from said high voltage applying unit, said film cover covers said electrode support arm of said external electrode unit in addition to said motor, and said needle electrode member of said external electrode unit is exposed from an electrode opening formed in said film cover.

6. The electrostatic coating apparatus according to claim 1, wherein said motor is supported to a housing member, and said film cover includes a cylindrical rear cover mounted to said housing member and a cylindrical front cover mounted on the front side of said rear cover to cover said motor.

7. The electrostatic coating apparatus according to claim 1, wherein said motor is supported to a housing member, said housing member is provided with an electrode cover part covering said external electrode unit, and said film cover is configured of a cylindrical front cover mounted on the front side of said electrode cover part to cover said motor.

* * * * *